US005825266A

United States Patent [19]

Gehrke

[11] Patent Number: 5,825,266

[45] Date of Patent: Oct. 20, 1998

[54] HIGH Q RESONATOR UTILIZING PLANAR STUCTURES

[75] Inventor: James K. Gehrke, Lake in the Wells, Ill.

[73] Assignee: Motorola, Inc., Schaumburg, Ill.

[21] Appl. No.: 864,664

[22] Filed: May 28, 1997

Related U.S. Application Data

[63] Continuation-in-part of Ser. No. 603,537, Feb. 20, 1996, abandoned, which is a continuation of Ser. No. 301,091, Sep. 6, 1994, abandoned.

[51] Int. Cl.[6] ..... H01P 7/08

[52] U.S. Cl. ..... 333/219; 333/246

[58] Field of Search ..... 333/219, 204, 333/246, 219.1

[56] References Cited

U.S. PATENT DOCUMENTS

| | | | |
|---|---|---|---|
| 4,706,052 | 11/1987 | Hattori et al. | 333/219 |
| 4,758,922 | 7/1988 | Ishigaki et al. | 361/330 |
| 5,350,639 | 9/1994 | Inoue et al. | 428/633 |
| 5,412,357 | 5/1995 | Nakamura et al. | 333/181 |

FOREIGN PATENT DOCUMENTS

| | | |
|---|---|---|
| 79601 | 3/1992 | Japan . |

*Primary Examiner*—Don Wong
*Assistant Examiner*—David H. Vu
*Attorney, Agent, or Firm*—Frank M. Scutch, III

[57] ABSTRACT

A high Q planar resonator (200) which includes a plurality of interconnected planar runners (209, 211, 213) which decrease in width on multiple layers of substrate material (203). The invention produces a high Q by using multiple conductor layers as the center conductor to reduce current crowding.

7 Claims, 2 Drawing Sheets

HIGH Q RESONATOR UTILIZING PLANAR STUCTURES

This is a CIP of U.S. application Ser. No. 08/603,537 filed Feb. 20, 1996, abandoned which was a file wrapper continuation of U.S. application Ser. No. 08/301,091 filed Sep. 6, 1994, and now abandoned.

TECHNICAL FIELD

This invention relates in general to high Q resonators and more particularly to planar resonators.

BACKGROUND OF THE INVENTION

High Q resonators are commonly used in telecommunications products to make filters or voltage controlled oscillators. One very common design approach to such resonators is the use of microstrip transmission lines. These lines are made of planar materials that allow low cost manufacturing processes. But microstrip transmission lines have a significant reduction in the critical factor of resonator Q due to non-uniform current distribution producing increased metalization loss. Trough line resonators are commonly used to improve the Q over a microstrip resonator because this type of resonator produces a more even or uniform current distribution for better metalization loss .

FIG. 1 shows cross-sectional view of a typical trough line resonator 100. The resonator may take any shape but includes a ground plane 101, unitary substrate 103 and trough area 105. The disadvantage associated with this, and other trough line resonators in the prior art, is the trough area 105 must be made by a complex molding process requiring three dimensional masking and plating. This translates into an overall increase in manufacturing costs and time expenditures. Therefore, the need exists to produce a trough line resonator which is easy to manufacture yet can produce a high Q factor which can be used to reduce current crowding.

DETAILED DESCRIPTION OF THE PREFERRED EMBODIMENT

Figure 1:
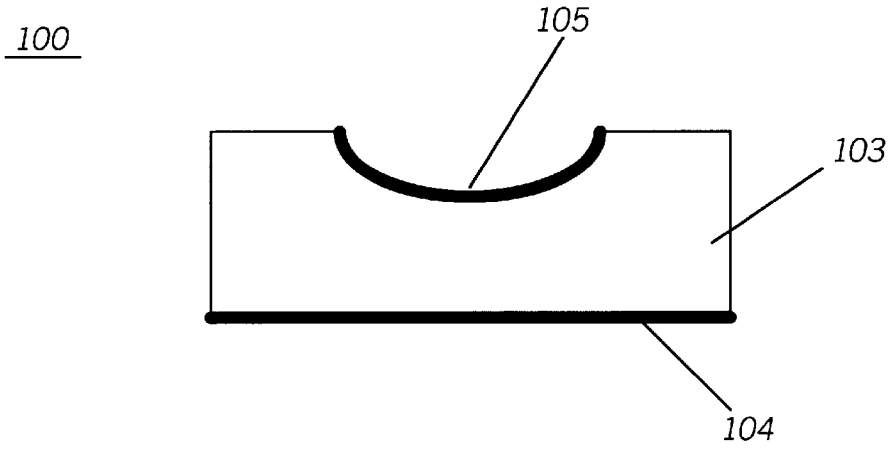
FIG.1 (PRIOR ART)
FIG. 1 is a cross-sectional view of a typical trough line resonator used on the prior art.
Figure 2:
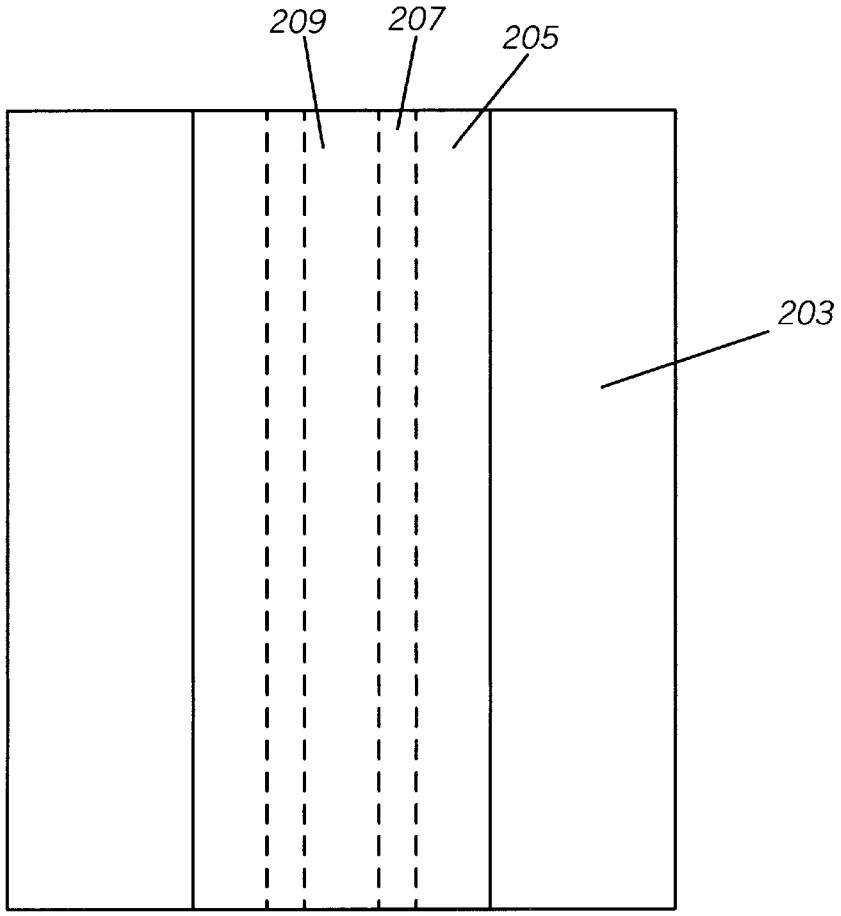
FIG. 2 is a top view of a planar high-Q planar resonator made with planar structures used in the present invention.
Figure 3:
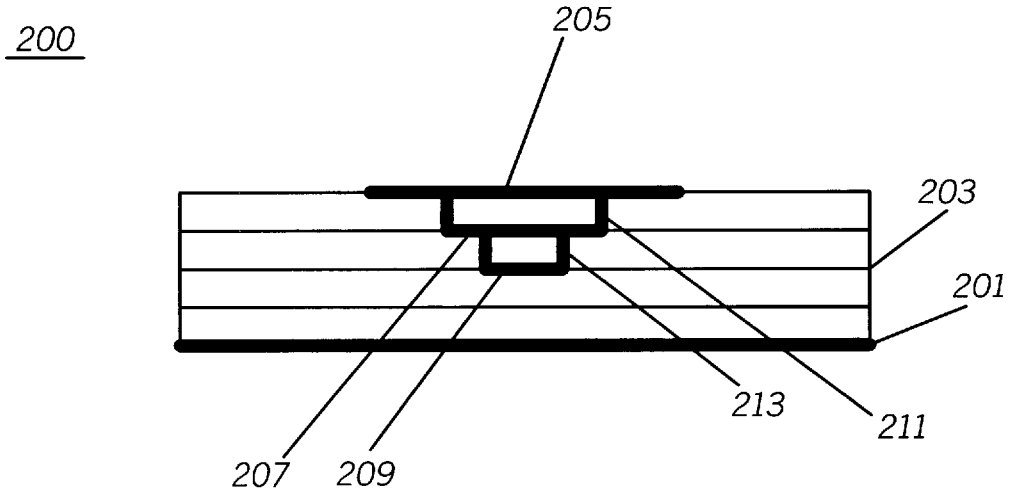
FIG. 3 is a cross-sectional view of a planar high-Q resonator shown in FIG. 2.

Referring now to FIGS. 2 and 3, the planar resonator structure of the present invention is shown generally at 200. The planar resonator includes a conductive ground plane 201 which underlies a multi-layer substrate 203. This substrate is typically made of an insulating material with good dielectric properties such as alumna or epoxy laminates. At the side of substrate 203 opposite ground plane 201 lies a first microstrip 205. First microstrip 205 is substantially planar and is essentially an electrical conductor or runner which is either embedded or attached to the surface of the substrate 203. Similarly, a second microstrip 207 which is smaller in cross-sectional area than first microstrip 205, is placed directly below the first microstrip 205. Second microstrip 207 is placed on to a separate layer of multi-layer substrate 203. Finally, a third microstrip 209, smaller in cross-sectional area than both said first microstrip 205 and second microstrip 207 is placed in a separate layer of substrate 203 directly below the second microstrip 207.

Each of first microstrip 205, second microstrip 207 and third microstrip 209 are connected through the respective layers of substrate 203 using blind vias 211 and 213 respectively. Each of microstrips 205, 207 and 209 as well as vias 211 and 213 are manufactured of conductive materials to promote a high current flow in resonator 200. It will be evident to those skilled in the art, that although each microstrip 205, 207 and 209 is shown positioned substantially in alignment, they may also be placed in a staggered fashion so as not to align one on top of the other.

The present invention produces a significant Q advantage over prior art structures which utilize a single microstrip transmission line. This occurs in view of first microstrip 205, second microstrip 207 and third microstrip 209 which are arranged to be electromagnetically coupled. This has the effect of producing a more even i.e. substantially equalized current distribution with a desired Q improvement similar to a standard trough line resonator without the burden of casting a non planar resonator. It will also be evident to those skilled in the art that as the number of layers of microstrip transmission lines increase, the Q factor approaches that of an actual trough line resonator. This is shown in FIG. 3 where each of the first microstrip 205, second microstrip 207 and third microstrip 209 form a resonator arranged or oriented to approximate a trough having a semi-elliptical shape having a substantially equalized current distribution. As can be seen from FIG. 3, each of the planar microstrip sections are positioned to form a semi-elliptical shape with the smallest cross-sectional microstrip located the greatest distance inward from the outer surface of the multi-layer substrate 203. Thus, each microstrip decreases in cross-sectional area as it is positioned inwardly from the multi-layer substrate 203.

In summary, a high Q planar structure resonator is produced by using first microstrip 205, second microstrip 207 and third microstrip 209 which form a center conductor. Each of these resonators are each subsequently reduced in cross-sectional area and arranged closer to the ground plane to equalize current in each conductor and to reduce current crowding. This allows a high Q resonator to be formed using only these simple and inexpensive planar structures which reduces cost and time to mold a standard non-planar type resonator.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A high Q multi-layer resonator comprising:

a multi-layer substrate;

a plurality of conductors each having a respective cross-sectional area and each embedded on respective layer of the multi-layer substrate;

at least one via for interconnecting the plurality of conductors through the multi-layer substrate; and wherein the cross-sectional area of each of the plurality of conductors is successively reduced so as to approximate a semi-elliptical resonator having a substantially equalized current distribution throughout the plurality of conductors.

2. A high Q resonator as in claim 1 wherein the plurality of conductors are printed circuit runners.

3. A high Q resonator as in claim 1 wherein the at least one via is a blind via.

4. A multi-layer planar resonator structure comprising:

a substrate having a plurality of layers;

a plurality of runners positioned on respective layers of the substrate;

a plurality of vias for interconnecting the plurality of runners through the plurality of layers; and wherein each of the plurality of runners decrease in cross-sectional area so as to substantially approximate a semi-elliptical resonator with substantially equalized current distribution.

5. A method of forming a high Q resonator as in claim 4 wherein the respective runners are interconnected with vias.

6. A method as in claim 4 wherein the runners are substantially planar.

7. A method of forming a high Q resonator for approximating a trough-like configuration in a multi-layer substrate, comprising the steps of:

positioning a respective runner on at least two layers of the multi-layer substrate;

decreasing the cross-sectional area of the at least two layers of the multi-layer substrate; and interconnecting the respective runners through the multi-layer substrate to form a semi-elliptical resonator having substantially equalized current distribution.

* * * * *